United States Patent [19]

Kobayashi

[11] Patent Number: 4,836,126

[45] Date of Patent: Jun. 6, 1989

[54] ANCHOR RETRIEVING DEVICE

[76] Inventor: Satoru Kobayashi, 33-8 Taishido 5-chome, Setagaya-ku, Tokyo-to, 154, Japan

[21] Appl. No.: 182,175

[22] Filed: Apr. 15, 1988

[30] Foreign Application Priority Data

Jun. 19, 1987 [JP] Japan ..... 62-151368

[51] Int. Cl.[4] ..... B63B 21/24

[52] U.S. Cl. ..... 114/297

[58] Field of Search ..... 114/299, 310, 311, 217, 114/378, 379; 294/66.1, 82.33; 43/17, 12, 17.2, 43.12, 43.4, 44.95; 244/137 R

[56] References Cited

U.S. PATENT DOCUMENTS

| | | | |
|---|---|---|---|
| 7,207 | 3/1850 | Bell | 114/311 |
| 2,490,460 | 12/1949 | McAvoy | 114/294 |
| 2,669,962 | 6/1954 | Christie | 114/294 |
| 2,764,116 | 9/1956 | Brewer | 114/310 |
| 3,150,629 | 9/1964 | Fields | 114/297 |
| 3,809,001 | 5/1974 | Shute | 114/297 |
| 3,841,255 | 10/1974 | Mansfield | 114/297 |
| 4,565,026 | 1/1986 | Bohme | 43/43.12 |
| 4,721,054 | 1/1988 | Kobayashi | 114/299 |

FOREIGN PATENT DOCUMENTS

| | | |
|---|---|---|
| 0206530 | 12/1986 | European Pat. Off. . |
| 1328456 | 8/1988 | United Kingdom . |

OTHER PUBLICATIONS

European Patent Office Search Report (Application No. EP88303763).

*Primary Examiner*—Joseph F. Peters, Jr.
*Assistant Examiner*—E. Swinehart
*Attorney, Agent, or Firm*—Laff, Whitesel, Conte & Saret

[57] ABSTRACT

An anchor retrieving device adapted to be interposed between an anchor and one end of a main anchoring line. The anchor includes a shank having a crown end and at least one fluke. The anchor retrieving device comprises: a lock assembly having an upper end connected to the one end of the main anchoring line and a lower end connected to the crown end of the anchor through an anchor-retrieving line; a releaseable hook member having one end normally locked by the lock assembly and the other end normally housed in the lock assembly at a position adjacent to the lower end of the lock assembly, the other end being connected through a connection line to the end of the shank opposite to the crown end; and a weight slidably engaging the main anchoring line and dropped downwardly along the main anchoring line to strike the lock assembly; the lock assembly including a housing for accommodating the releaseable hook member during the normal anchoring operation, a movable locking block housed in the housing for movement between a locking position and an unlocking position along the axial direction of the housing, and a spring normally biasing the movable locking block into its locking position and releasing the releaseable hook member when struck by the weight to allow the releaseable hook member to come out of the housing.

5 Claims, 8 Drawing Sheets

ANCHOR RETRIEVING DEVICE

BACKGROUND OF THE INVENTION

1. Field of the Invention

The present invention relates generally to an improvement in or relating to anchors, and particularly to an anchor retrieving device adapted to be interposed between an anchor and one end of a main anchoring line to retrieve the anchor when it becomes snagged at the bottom of a body of water, for example, seized by roots or ledges of rocks or submerged timbers or like.

2. Related Art Statement

It might often arise a case where an anchor becomes snagged by roots, rocks or like to make it impossible to raise the anchor to the boat. In order to release the anchor and to bring the same in the condition for easy raising, I have previously proposed an anchor arrangement. The anchor arrangement according to my previous proposal, comprises a flexible rope having a free end, retaining device for detachably retaining the free end of the rope and being attached to the rope and normally held at a position separated from the free end of the rope by a certain distance, an anchor attached to the rope and having a shank and at least one grasping means (fluke in one embodiment) extending backwardly from one end of the shank for grasping a rock at the bottom of a body of water. The shank of the anchor is attached to the rope so that the one end formed with the fluke is positioned remoter from the free end of the rope. The arrangement further comprises means for opening the retaining device so that the free end of the rope is released therefrom in readiness for the anchor raising operation, upon impingement or striking by a weight.

The anchor arrangement of my prior proposal is disclosed in my co-pending U.S. patent application Ser. No. 06/865,115 which was filed while claiming a Convention Priority based on Japanese Patent Appln. No. 115232/1985 (Japanese Patent Laid-Open Publication No. 275085/1986), and a corresponding European patent application was also filed and given with EPC No. 86303937.6. This is also disclosed in my Japanese Patent Appln. No. 173924/1986. The specification of the aforementioned U.S. Patent Application will be incorporated herein as a reference.

In my previous arrangement, the means for opening the retaining device is a hook which is opened as it is struck by the weight. One end of the hook is pivoted by a pin to the main body of the retaining device. The other movable end is engaged and retained by a lock pawl to the main body of the retaining device under the closed condition, and disengaged from the lock pawl under the opened condition.

However, this arrangement has a disadvantage that sands, soils or muds on the bottom of a body of water tends to adhere to the portions around and vicinal to the pivot pin as the retaining device contacts with sands or other particles, leading to the result that the device is gotten clogged to reduce reliability in releasing action. There is also a problem that all of the loading applied to the anchor is transmitted to the pivot pin of the hook, so that smooth action of the hook has been fatally lost, should the pin be bent or otherwise deformed by such an extremely high loading. A further disadvantage of this arrangement is its inherent poor operationability. This poor operationability or difficulty in setting is caused by the necessity that the free end of a section of the rope, which is connected to the end of the shank opposite to the crown end, must be trapped by the hook and then the hook is latched by the lock pawl.

OBJECTS AND SUMMARY OF THE INVENTION

The primary object of this invention is to provide an anchor retrieving device adapted to be interposed between an anchor and one end of a main anchoring line, which operates reliably to retrieve an anchor when the anchor becomes snagged by any obstacles which hinder smooth raising of the anchor.

Another object of this invention is to provide such an anchor retrieving device which can be operated easily by a simple operation from an operator who gets aboard of the boat or ship.

A further object of this invention is to provide such an anchor retrieving device wherein a releaseable hook member is combined with a lock assembly and the releaseable hook is connected to and disconnected from the lock assembly without the use of any pivot pin or like means which is easily gotten clogged by sands, muds or soils.

A still further object of this invention is to provide an anchor retrieving device comprising a rereaseable 10 hook member and a lock assembly and wherein the former is directly connected to and disconnected from the latter to simplify the set operation.

With the aforementioned objects in view, the present invention provides an anchor retrieving device adapted to be interposed between an anchor and one end of a main anchoring line, the anchor including a shank having a crown end and at least one fluke, wherein an anchor retrieving device comprises:

a lock assembly having an upper end connected to the one end of the main anchoring line and a lower end connected to the crown end of the anchor through an anchor-retrieving line;

a releaseable hook member having one end normally locked by the lock assembly and the other end normally housed in the lock assembly at a position adjacent to the lower end of the lock assembly, the other end being connected through a connection line to the end of the shank opposite to the crown end; and a weight slidably engaging the main anchoring line and dropped downwardly along the main anchoring line to strike the lock assembly;

the lock assembly including a housing for accommodating the releaseable hook member during the normal anchoring operation, a movable locking block housed in the housing for movement between a locking position and an unlocking position along the axial direction of the housing, and biasing means normally biasing the movable locking block into its locking position and releasing the releaseable hook member when struck by the weight to allow the same to come out of the housing.

DESCRIPTION OF THE APPENDED DRAWINGS

The above and other objects and merits of this invention will be easily understood by those skilled in the art by reading the following detailed description of a presently preferred embodiment thereof while referring to the appended drawings, in which.

DESCRIPTION OF THE PREFERRED EMBODIMENT

Figure 1:
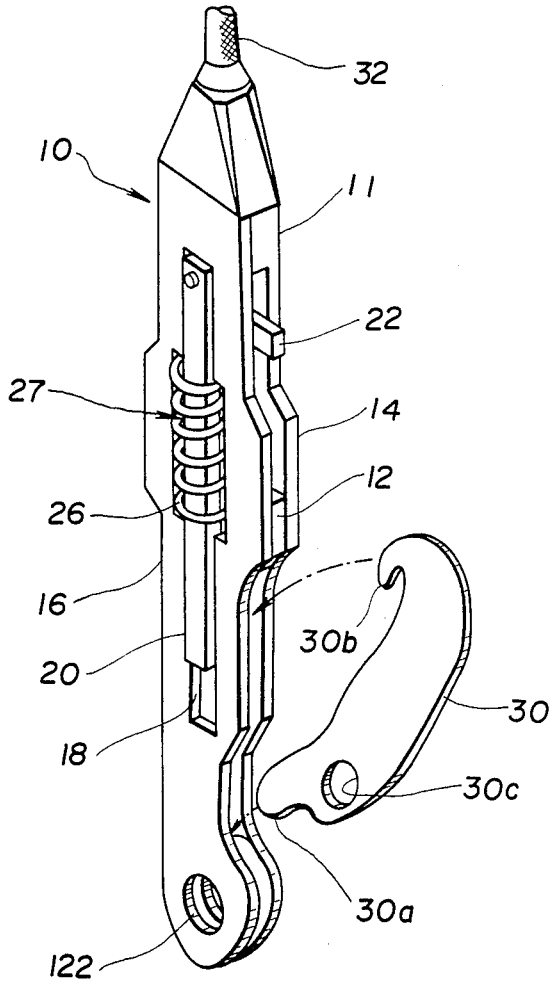
FIG. 1 is a perspective view showing an embodiment of this invention, with parts omitted for simplicity of illustration.

The present invention will now be described in detail by referring to a presently preferred embodiment thereof.

Referring to the drawings showing a preferred embodiment of this invention, a lock assembly is denoted generally by reference numeral 10 and has an upper end connected to a main anchoring line 32. The lock assembly 10 has a housing 11 which is defined by a core plate 12, paired side wall plates 14, 16 securedly fitted to cover the sides of the core plate 12 by welding or using screws or other securing means, each of the side wall plates 14, 16 having a longitudinal slot 18 extending along the longitudinal direction of the housing 11. A pair of guide rods 20, 20 are housed in the longitudinal slots 18, 18 of the side wall plates 14, 16 to be moved along the longitudinal direction. An upper crossing member 22 is pivotally carried at an upper portion of the guide rods 20, 20, and a lock pawl 24 is carried by the lower end of the guide rods 20, 20. A coil spring 26 surrounds the guide rods 20, 20 and has a lower end circumference seated on the bottom ledges of enlarged portions or windows 28 of the longitudinal slots 18. The top end circumference of the coil spring 26 abuts against the bottom of the upper crossing member 22 to urge the member 22 maintained at its upper position under normal condition when no striking force is applied on the member 22. Both ends of the upper crossing member 22 protrude beyond the side wall plates 14, 16 to be struck by a weight 34 as will be described hereinafter.

The guide rods 20, the upper crossing member 22 and the lock pawl 24 are thus connected together and movably housed in the housing 11 of the lock assembly 10 while being applied with a biasing force by the coil spring 26 to form a movable locking block 27.

A releaseable hook member 30 is contained in the housing 11 of the lock assembly 10 securedly in the anchoring condition as it is contained in the housing 11 of the lock assembly 10 to be set for anchoring, and it is readily released from the lock assembly 10 in response to the operation by a person who is staying on the boat when it is desired to separate the anchor from any massive obstacle which hinders raising of the anchor. Now referring to the drawings, particularly to FIGS. 2 and 3, the releaseable hook member 30 has a thickness slightly thinner than the wall thickness of the core plate 12 to be loosely set in the gap or space between the side wall plates 14 and 16, and has a generally crescent shape in the illustrated embodiment. The releaseable hook member 30 has at its one end, which would be referred to as the "lower end" in some portions of the following description for the convenience of description, a rounded lug or first hook end **30*a* which is snugly received by a cut-out 12*a* formed at the lower portion of the core plate 12 and covered by the side wall plates 14 and 16. The cut-out 12*a* has an opening which is slanting at a certain angle relative the longitudinal direction of the side wall plates 14, 16 so that the first hook end 30*a* is inserted from the upside of the cut-out 12*a* at the initial step for connecting the hook member 30 with the lock assembly 10. The other end, which would be referred to as the "upper end" in some portions of the following description for the convenience of description, forms a latch end 30*b* for engaging with the lock pawl 24**.

In order to connect the hook member 30 with the lock assembly 10 to set the same to normal anchoring condition, the first hook end **30*a* of the hook member 30 is inserted in the cut-out 12*a* at the lower portion of the lock assembly 10, and then the upper portion of the hook member 30 is pushed in the space between both side wall plates 14, 16, whereupon the latch end 30*b* of the hook member 30 pushes the lock pawl 24 downwards against the biasing force of the coil spring 26. As the inner face of the latch end 30*b* engages with the latch seat formed on the backside of the lock pawl 24 and the movable locking block 27 is moved again to the upper position under the action of the coil spring 26, the releaseable hook member 30 is securedly and firmly locked to the lock assembly 10**.

Figure 3:
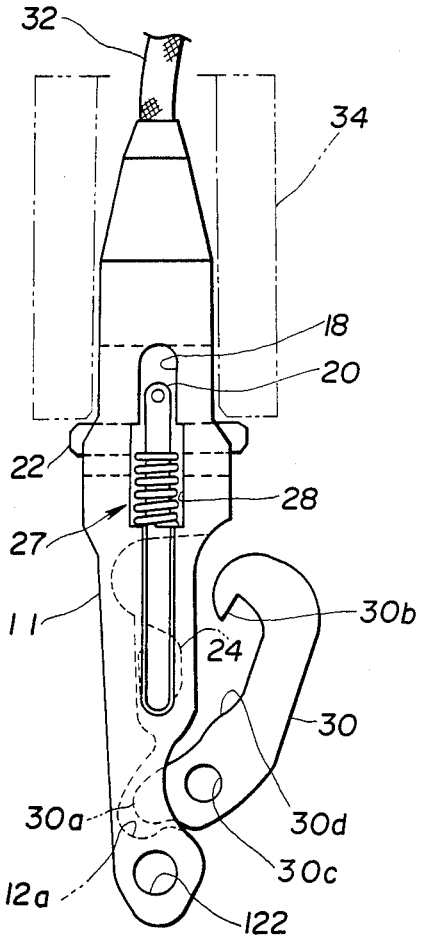
FIG. 3 is a view similar to FIG. 2, with the releaseable hook member being unlocked from the lock assembly.
Figure 4:
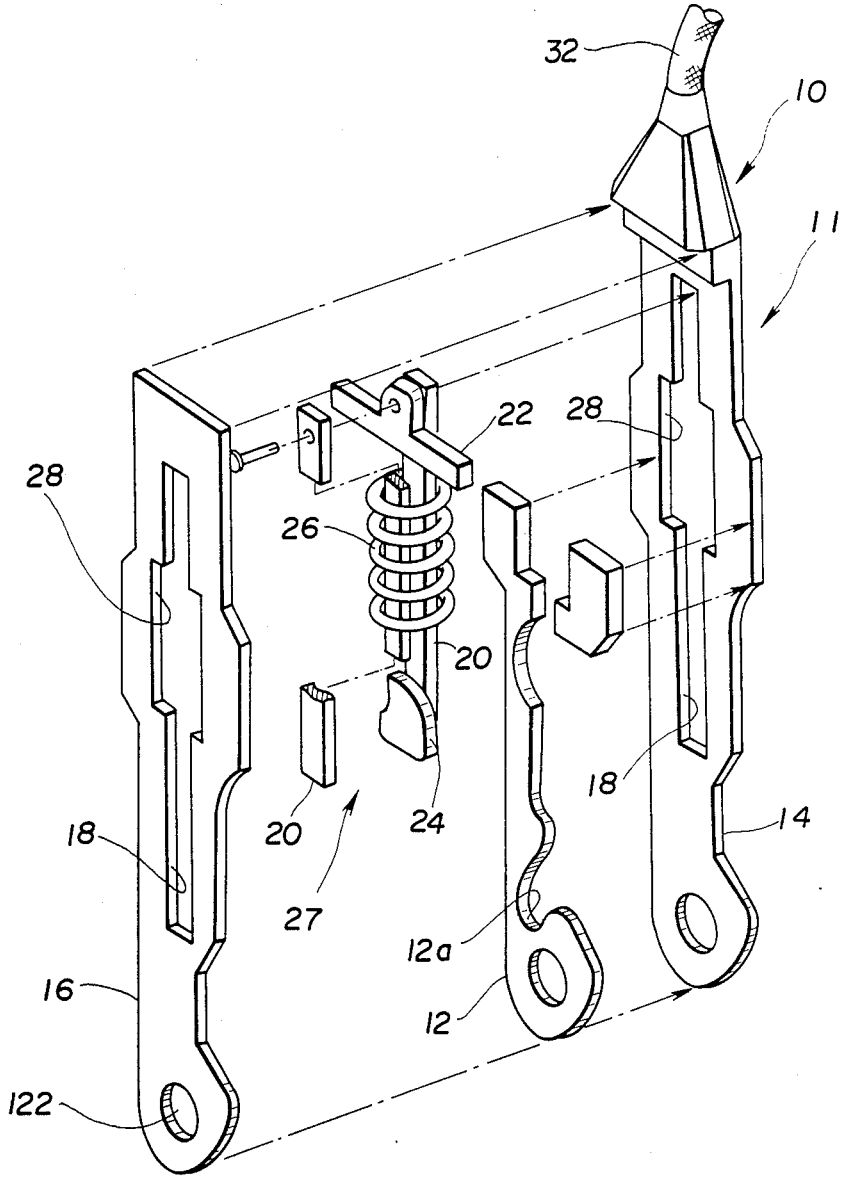
FIG. 4 is an exploded perspective view showing the parts of the embodiment shown in FIGS. 1 to 3, with portions of some members being cut away for easy understanding.

The top ends of both side wall plates 14, 16 are connected through an untwisting arrangement (not shown) to the main anchoring line 32 drawn out from the boat, and have side edges or shoulders slanting to converge upwardly. A generally cylindrical weight 34 is shown in FIGS. 3 and 6, and the weight 34 in this embodiment is composed of two half-cylinders connected with each other by hinges **34*a* (see FIG. 6) to be opened and closed as desired, the weight 34** being fixed to its closed condition by means of locking means (not shown).

Figure 5:
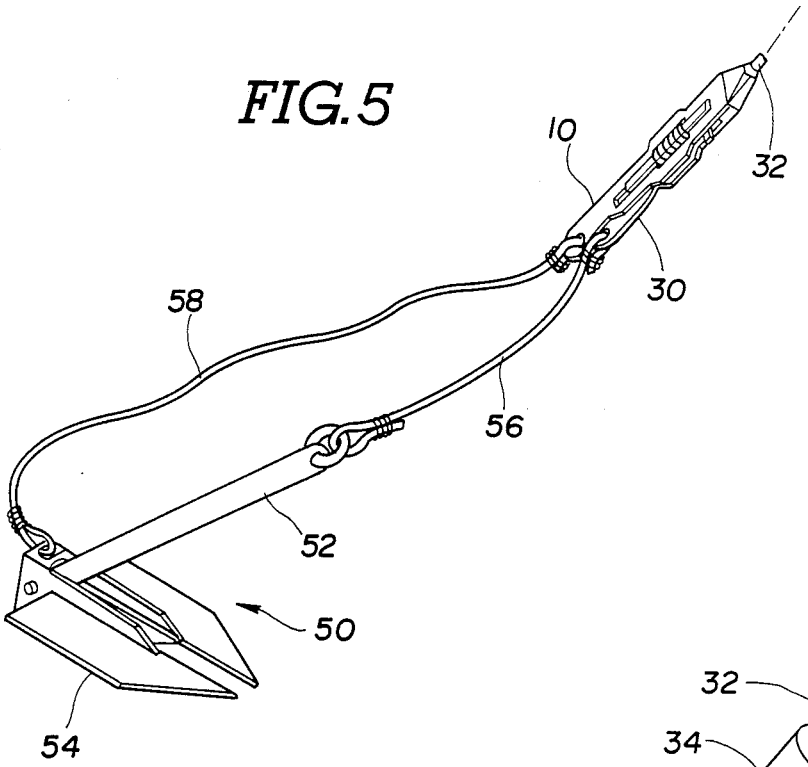
FIG. 5 is a perspective view showing the embodiment of FIG. 1, which is combined with a usual anchor and set to be in condition for anchoring.
Figure 6:
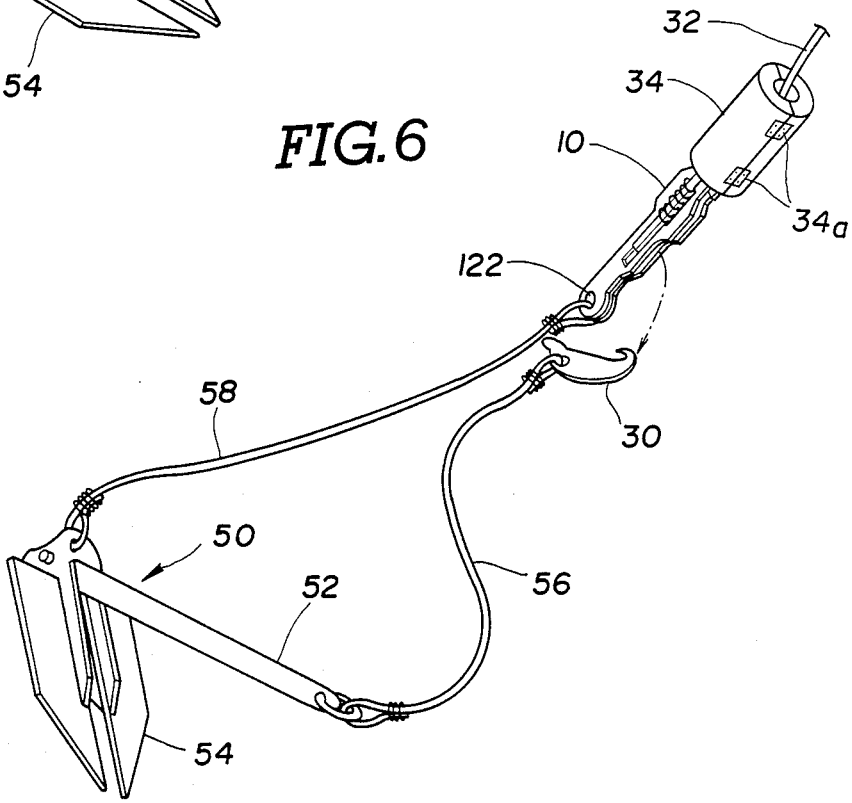
FIG. 6 is a view similar to FIG. 5, but showing the combination of the anchor and the anchor retrieving device in the condition for anchor raising operation.

Referring now to FIGS. 5 and 6, a Danforth type anchor 50 has a shank 52, and flukes 54 are attached to the crown end of the shank 52 to be swingable within a certain angular range. The end opposite to the crown end of the shank 52 is connected to one end of a connection line 56. The other end of the connection line 56 is connected to the lower end, i.e. the end close to the first hook end **30*a*, of the releaseable hook member 30. The crown end of the shank 52 vicinal to the root portions of the flukes 54 is connected through an anchor-retreiving line 58 to the lower end of the lock assembly 10. The length of the connection line 56 is determined so that the tension in the main anchoring line 32 is transmitted through the connection line 56 to the end opposite to the crown end of the shank 52 when the releaseable hook member 30 is securedly retained by the lock assembly 10, and the anchor-retrieving line 58 is kept slack to prevent the relatively weak anchor-retrieving line 58 from transmitting an extensive force needed to anchor the boat or ship. In the condition as shown in FIG. 5, wherein the releaseable hook member 30 is assembled or set to the lock assembly 10**, the entire arrangement is used as a usual anchoring system.

In an event when the anchor 50 is caught by roots of seaweeds, rocks or other massive obstacles and the anchor 50 cannot be raised by a simple operation, the releaseable hook member 30 may be released from the lock assembly 10 by moving the movable locking block 27 downwardly as shown in FIG. 6. In order to release the hook member 30 from the lock assembly 10, the weight 34 is mounted around the main anchoring line 32 so that the line 32 is loosely surrounded by the inner periphery of the cylinderical weight 34, and then the weight 34 is dropped along the main anchoring line 32. The weight 34 strike the protruding ends of the upper crossing member 22, as best shown by the dots-and-dash line in FIG. 3, so that the upper crossing member 22, guide rods 20, 20 and the lock pawl 24 are moved downwards against the biasing force of the coil spring 26. Whereupon, the lock pawl 24 is disengaged from the latch end **30*b* of the releaseable hook member 30, and then the hook member 30 is swung about the lowest end thereof in the clockwise direction as seen in FIG. 3 until the lower rounded lug or first hook end 30*a* of the hook member 30 comes out of the cut-out 12*a* of the core plate 12. Thus, the hook member 30 is released from the lock assembly 10**.

Figure 2:
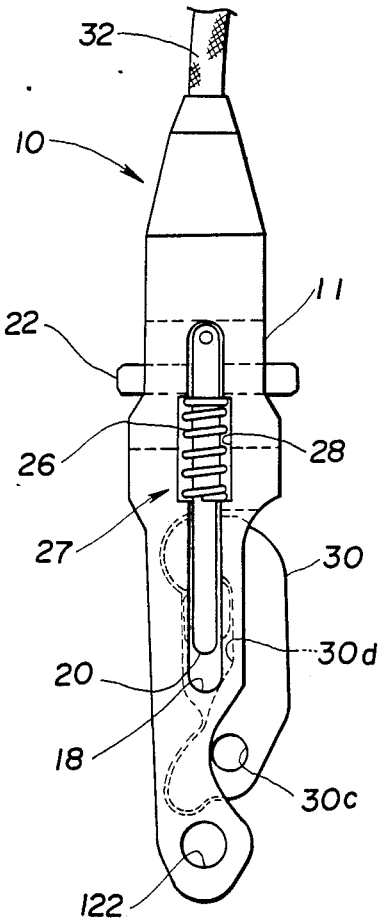
FIG. 2 shows an elevation of the embodiment of FIG. 1, wherein the releaseable hook member is accommodated in the lock assembly to be locked by the latter.

As best seen from FIG. 2, the releaseable hook member 30 is formed with an engagement hole **30*c* to which one end of the connection line 56 is bound in a way so that the point to which the connection line 56 is bound or secured is somewhat deviated outwards (toward the right-hand direction in FIG. 2) from the linear line extending from the center axis of the main anchoring line 32 to the point at which said lower end of the hook member 30 engages with the cut-out 12*a* formed at the lower end of the core plate 12. This deviation contributes the effect that the tension from the connection line 56 acts on the hook member 30 to force the second hook end or latch end 30*b* to swing in the direction to be unlocked from the lock pawl 24 when the weight 34 strikes to lower the movable locking block 27 to disengage the latch end 30*b* from the latch seat on the backside of the lock pawl 24 (in FIG. 2, the latch end 30*b* is swung in the right-hand direction). Release or separation of the releaseable hook member 30 from the lock assembly 10** can be ensured by such a deviation.

According to another advantageous aspect of the illustrated embodiment, the hook member 30 has an inner periperal edge having an inclined portion **30*d* engaging with the lower end of the movable locking block 27, more specifically the bottom edge of the lock pawl 24, so that the hook member 30 is pushed outwardly (toward the right-hand direction in FIGS. 2 and 3) from the housing 11 of the lock assembly 10 when the movable locking block 27 is pushed downwards upon striking by the weight 34. As a result, release or separation of the releaseable hook member 30 from the lock assembly 10** is surely and positively achieved.

After the releaseable hook member 30 is released together with the connection line 56, the connection between the main anchoring line 32 and the end of the shank 52 opposite to the crown end, through the lock assembly 10 and the connection line 56, is disconnected, so that the anchor 50 is connected solely through the anchor-retrieving line 58 with the crown end of the line 58 being applied with a tension force as an anchor-raising force is transmitted. Thus, by hoisting or otherwise hauling the main line 32, the anchor 50 is raised with its crown side held upside to result in success for retrieval thereof from the snagged condition.

Figure 7:
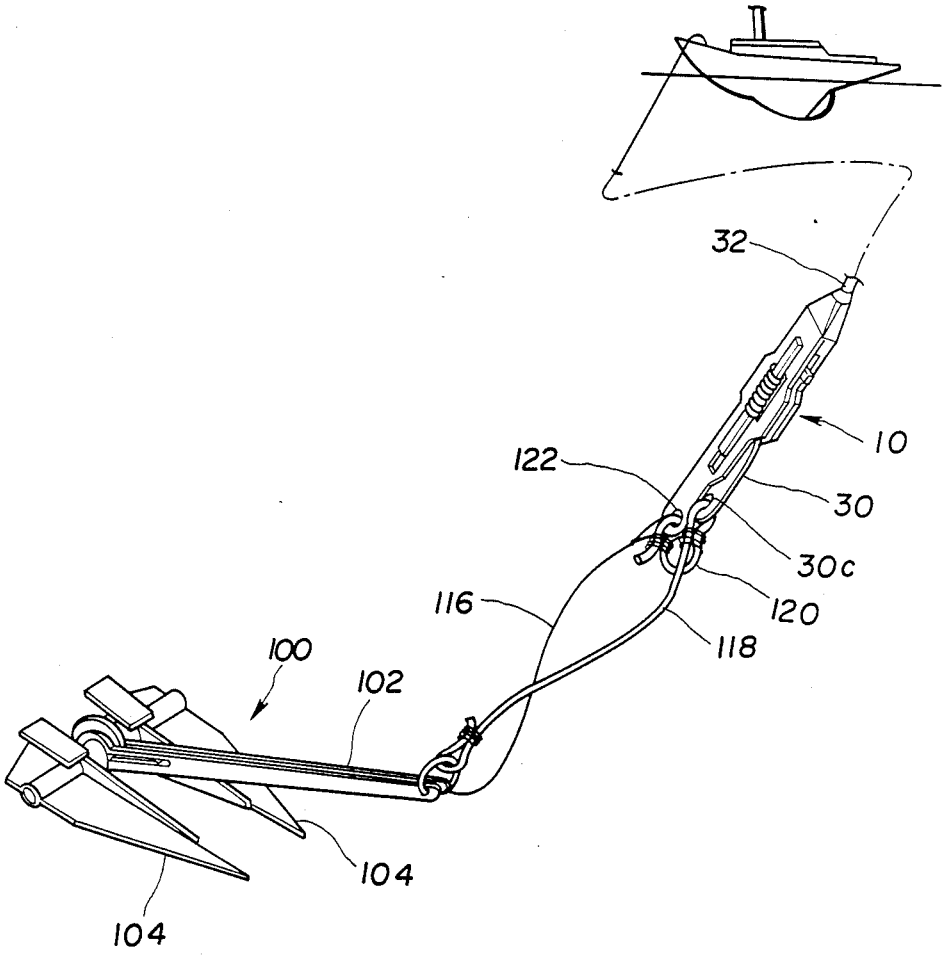
FIG. 7 is a diagrammatical illustration showing the embodiment combined with an anchor of another type, the anchor retrieving device being shown as in the normal anchoring condition.
Figure 8:
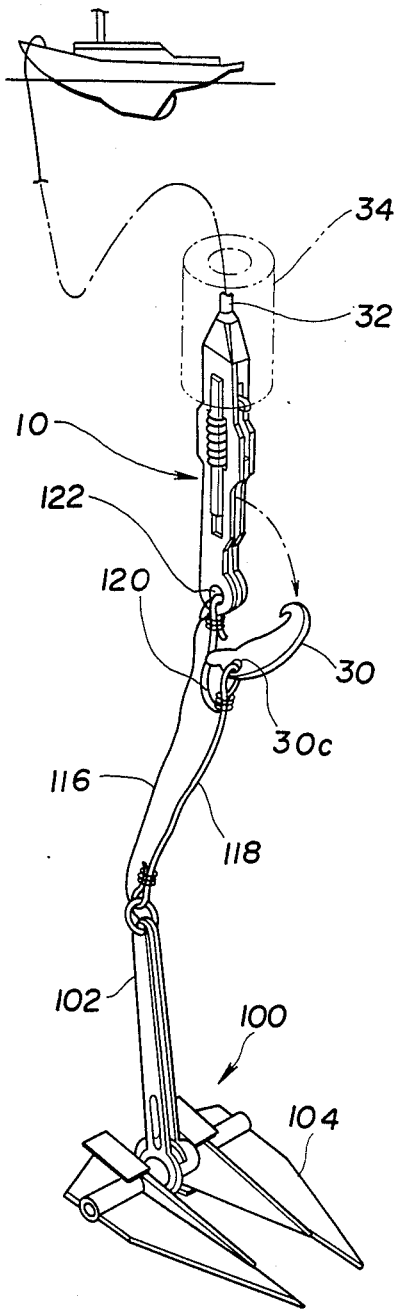
FIG. 8 is a view similar to FIG. 8, showing the same combination as in FIG. 7 with the releaseable hook member coming out of the lock assembly.

FIGS. 7 and 8 show the anchor retrieving device of this invention, wherein a second embodiment which is generally similar to the first embodiment described with reference to FIGS. 1 to 6 is combined with a modified Danforth type anchor 100. FIG. 7 shows the combination which is in the normal anchoring condition; whereas FIG. 8 shows the same combination in the condition immediately after the releaseable hook member 30 is disengaged from the lock member 10. This second embodiment of the anchor retrieving device constructed in accordance with this invention and used in the combination shown in FIGS. 7 and 8 is identical with the first embodiment, except that the connection line 56 of the first embodiment is divided into a major line segment 118 and a minor line segment 120, the major line segment 118 and the minor line segment 120 being joined together at a joining point to which connected is a link bound to the engagement hole **30*c* formed at the lower end portion of the releaseable hook member 30**.

Figure 9:
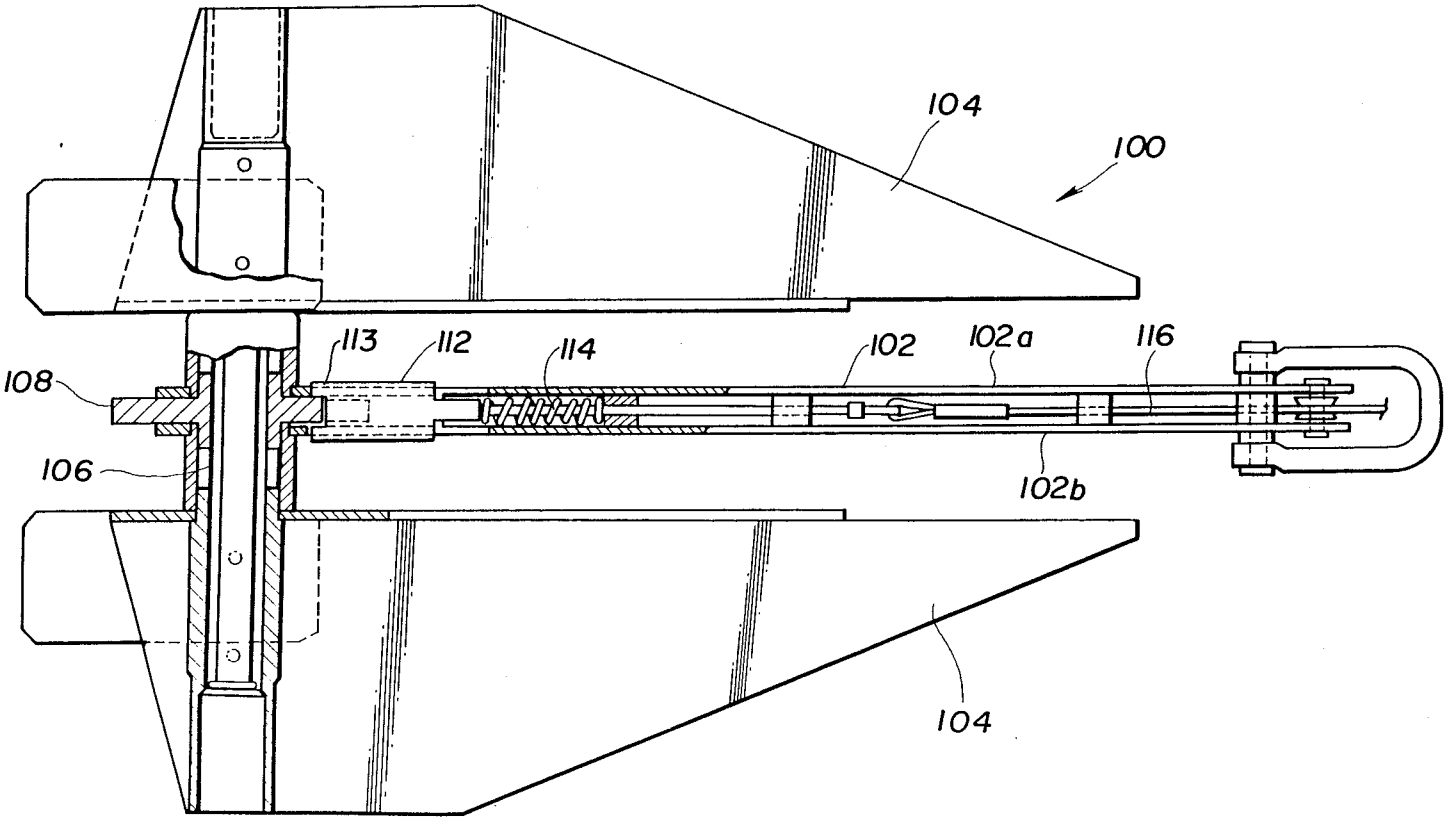
FIGS. 9 and 10 are elevational and plan views of the anchor used in the combination shown in FIGS. 7 and 8.
Figure 10:
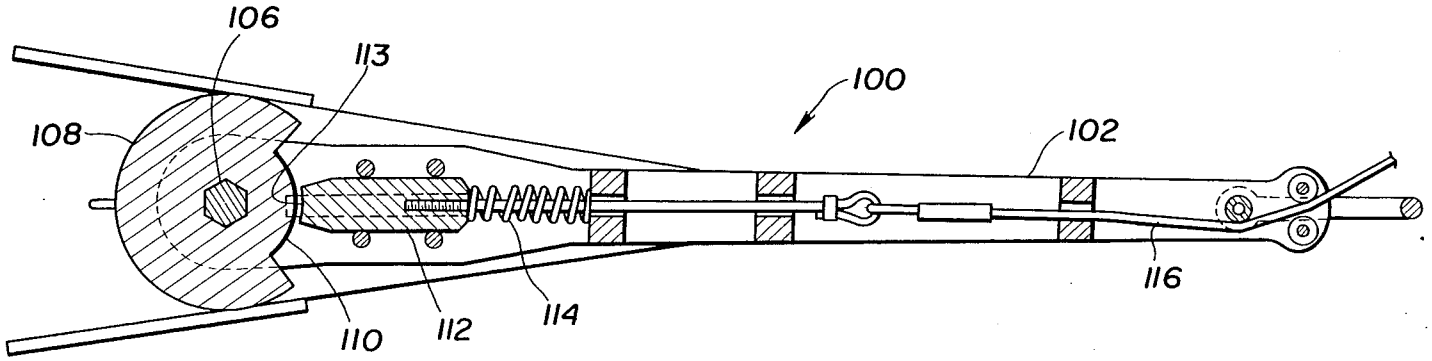

Referring now to FIGS. 9 and 10 showing, respectively, elevational and plan views of the modified anchor 100 used in this combination, the structure and operation of the anchor 100 will now be described.

The anchor 100 comprises a shank 102, and two flukes 104 swingably attached to the crown end of the shank 102. The anchor 100 further comprises lock means for limiting the swinging angle of the flukes 104 under normal anchoring position, and unlock means for unlocking the lock means to allow the flukes 104 to swing beyond the limited angular range. In the illustrated embodiment, the shank 102 is formed of two elongated plates **102*a*, 102*b* placed in face-to-face relationship with each other and spaced by a certain gap. A shaft 106 having a hexagonal section extends through the fore ends or crown ends of the two elongated plates 102*a*, 102*b*, and a cam disk 108 is mounted on the shaft 106 to be rotated within the gap defined by the two elongated plates 102*a*, 102*b*. A pair of flukes 104 are fixedly carried by the ends of the shaft 106 so that the flukes 104 may be swung relative to the center axis of the shank 102. As will be seen from FIG. 10, the cam disk 108 has a portion cut out to define a recessed segment 110 subtending an angular range of below 180°. A lock key 112 carried by the shank 102 and has a cam follower end 113 disengageably received in the recessed segment 110. The lock key 112 is biased by a spring 114 so that the cam follower end thereof abuts against the circumferencial face of the recessed segment 110 in the normal condition when the anchor 100 takes the anchoring position or posture, and may be pulled by an anchor retrieving line 116 against the biasing force of the spring 114 so that the cam follower end 113 of the lock key 112 comes out of the recessed segment 110**.

As shown in FIGS. 7 and 8, the anchor 100 is connected to the lock assembly 10 and the releaseable hook member 30 in the manner as described with reference to FIGS. 1 to 4. In detail, the end of the shank 102 opposite to the crown end is connected to the lower end of the hook member 30 through the major line segment 118 and the link, and the first hook end **30*a* is received in the cut-out 12*a* at the lower end of the lock assembly 10 (see FIGS. 2 and 3). The major line segment 118 is joined with one end of the minor line segment 120, as described above, and the other end of the minor line segment is connected to the hole 122 formed at the lower end of the lock assembly 10, the hole 122 of the lock assembly 10 also holds the other end, i.e. the end opposing to the end bound to one end of the shank 102, of the anchor retrieving line 116. It is noted here that the length of the major line segment 118 is slightly shorter than that of the anchor retrieving line 116, and the total length of the major line segment 118 plus minor line segment 120 is slightly longer than the length of the anchor retrieving line 116**.

Accordingly, under the condition shown in FIG. 7 where the hook member 30 is connected to the lock assembly 10, anchoring power is transmitted from the anchor 100 through the major line segment 118 and through the lock assembly 10 to the main anchoring line 32. Since the anchor retrieving line 116 is slack and no power is transmitted therethrough, the fore end (cam follower end) of the lock key 112 is received in the recessed segment 110. As a result, the swinging angular range of the flukes 104 is limited within the range defined by the angle of the recessed segment 110, so that the flukes 104 swing relative to the axis of the shank 102 within a designed angular range, generally within an angular range of below 90° to allow the entire anchor assembly 100 to act as a usual anchoring device.

In an event where either one or both of the flukes 104 is caught by some massive obstacle to render the anchor 100 to be snagged, the weight 34 is dropped along the main anchoring line 32 to strike the top of the lock assembly 10, whereupon the releaseable hook member 30 is released from the lock assembly 10. In this condition, since the total length of the major and minor line segments 118 and 120 is longer than the length of the anchor retrieving line 116, the anchor raising force is transmitted from the line 32 to the line 116 so that fore end of the lock key 112 is allowed to come out of the recessed segment 110. The shank 102 is now allowed to rotate around the whole circumference of the shaft 106 in this condition. At the initial stage of hauling the line 32, the pulling force is transmitted through the line 116 which in turn pulls the lock key 112, so that the shank 102 is rotated in the direction to bring the angle between the shank 102 and the flukes 104 into an obtuse angle. Thus, the flukes 104 are pulled from the base ends, i.e. the crown end of the shank 102, to be released from the massive obstacle which hinders anchor raising operation. It should be noted here that the line 116 is utilized only to tansmit a pulling force necessary for pulling the lock key 112 against the biasing force of the spring 114, and relatively high pulling force needed to separate the flukes 104 from the rocks or other massive obstacles and to raise the anchor 100 upwardly is transmitted through the minor line segment 120 and the major line segment 118 to the shank 102 to prevent the line 116 from being applied with excessively high power which might break down the relatively weak line 116.

What is claimed is:

1. An anchor retrieving device adapted to be interposed between an anchor and one end of a main anchoring line, an anchor including a shank having a crown end and at least one fluke, said anchor retrieving device comprising:

a lock assembly having an upper end connected to said one end of said main anchoring line and a lower end connected to said crown end of said anchor through an anchor-retrieving line;

a releaseable hook member having one end normally locked by said lock assembly and the other end normally housed in said lock assembly at a position adjacent to said lower end of said lock assembly, said other end being connected through a connection line to the end of said shank opposite to said crown end; and a weight slidably engaging said main anchoring line and adapted to be dropped downwardly along said main anchoring line to strike said lock assembly;

said lock assembly including a housing for accommodating said releaseable hook member during the normal anchoring operation, a movable locking block housed in said housing for movement between a locking position and an unlocking position along an axial direction of said housing, and biasing means normally biasing said movable locking block into its locking position and releasing said releaseable hook member when struck by said weight to allow said releaseable hook member to come out of said housing.

2. The anchor retrieving device according to claim 1, wherein said housing comprises paired side wall plates each having a longitudinal slot extending along the axial direction of said housing, and a core plate fixedly sandwiched between said paired side wall plates and having a lower portion formed with a cut-out for receiving said other end of said releaseable hook member; and wherein said movable locking block comprises guide rod means having lugs inserted into the longitudinal slots of said paired side wall plates, an upper crossing member having both ends extruding from said housing to be struck by said weight, and a lower lock pawl for engaging with said one end of said releaseable hook member.

3. The anchor retrieving device according to claim 2, wherein each of said paired side walls has a top shoulder portion converging toward an upper end of said housing.

4. The anchor retrieving device according to claim 2, wherein said releaseable hook member has a general shape of crescent with its inner peripheral edge having an inclined portion engaging with a lower end of said movable lock block so that said releaseable hook member is pushed outwardly from said housing when said movable lock block is moved downwards upon striking by said weight.

5. The anchor retrieving device according to claim 2, wherein said connection line is secured to said other end of said releaseable hook member at a position substantially deviated outwards from a linear line extending from the center axis of said main anchoring line to the point at which said other end of said releaseable hook member engages with said cut-out formed at the lower end of said core plate.

* * * * *